US010896788B2

(12) United States Patent
Mueller et al.

(10) Patent No.: US 10,896,788 B2
(45) Date of Patent: Jan. 19, 2021

(54) ELECTRONIC TRIP UNIT FOR A LOW-VOLTAGE CIRCUIT BREAKER INCLUDING A RECEPTACLE FOR A MODULE, AND A MODULE FOR CONNECTION TO THE ELECTRONIC TRIP UNIT

(71) Applicant: Siemens Aktiengesellschaft, Munich (DE)

(72) Inventors: Gerd Mueller, Falkensee (DE); Gerhard Tietz, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 346 days.

(21) Appl. No.: 16/019,774

(22) Filed: Jun. 27, 2018

(65) Prior Publication Data

US 2019/0013159 A1 Jan. 10, 2019

(30) Foreign Application Priority Data

Jul. 6, 2017 (DE) ..... 10 2017 211 552

(51) Int. Cl.

| | |
|---|---|
| ***H01H 9/22*** | (2006.01) |
| ***H01H 71/12*** | (2006.01) |
| ***H01H 71/02*** | (2006.01) |
| ***H01H 9/24*** | (2006.01) |

(52) U.S. Cl.

CPC ..... *H01H 9/22* (2013.01); *H01H 9/24* (2013.01); *H01H 71/0228* (2013.01); *H01H 71/123* (2013.01); *H01H 71/125* (2013.01)

(58) Field of Classification Search

CPC ..... H02H 5/04; H02H 5/041; H02H 5/048; H02H 5/08; H02H 6/00; H02H 7/00;

(Continued)

(56) References Cited

U.S. PATENT DOCUMENTS

| | | | | |
|---|---|---|---|---|
| 4,634,981 A * | 1/1987 | Shimp | H02H 3/044 | 324/424 |
| 4,706,158 A * | 11/1987 | Todaro | H02H 3/24 | 361/187 |
| 5,051,861 A * | 9/1991 | Purkayastha | H01H 73/14 | 340/639 |
| 5,331,501 A * | 7/1994 | Shimp | H02H 3/044 | 324/424 |
| 5,428,495 A * | 6/1995 | Murphy | G01R 19/16528 | 307/129 |
| 5,929,405 A * | 7/1999 | Wehrli, III | H01H 3/30 | 200/400 |

(Continued)

FOREIGN PATENT DOCUMENTS

| | | |
|---|---|---|
| DE | 102006018852 B3 | 9/2007 |
| DE | 102011089591 A1 | 6/2013 |
| DE | 102012215466 A1 | 3/2014 |

OTHER PUBLICATIONS

German Office Action #102017211552.1 dated May 18, 2018.

*Primary Examiner* — Thienvu V Tran
*Assistant Examiner* — Nusrat Quddus
(74) *Attorney, Agent, or Firm* — Harness, Dickey & Pierce, P.L.C.

(57) ABSTRACT

An electronic trip unit is for a low-voltage circuit breaker of a three-phase AC circuit. The electronic trip unit includes a housing with a front, rear, left-hand, right-hand, top and bottom face; a controller to compare current measurement values of the three-phase AC circuit with at least one of current limit values, current period limit values and time period limit values and to output a tripping signal, for interrupting the three-phase AC circuit, upon the values being exceeded. The electronic trip unit further includes a receptacle to provide a connection between the electronic trip unit and the module, the module being receivable by the left-hand, right-hand, top or bottom side face of the housing.

(Continued)

At least one function of the electronic trip unit is activated upon the module being received. The front face of the housing includes a viewing window. At least a portion of a received module is visible.

19 Claims, 2 Drawing Sheets

(58) Field of Classification Search
CPC ..... H02H 7/20; H02H 7/205; H02H 7/26; H02H 7/267; H02H 7/262; H02H 7/008; H02H 9/042; H02H 9/043; H02H 9/026; H02H 9/02; H02H 9/023; H02H 9/025; H02H 11/00; H02H 11/001; H02H 11/003; H02H 11/005; H02H 11/007; H02H 11/008; H02H 3/025; H02H 3/021; H02H 3/22; H02H 3/027; H02H 3/033; H02H 3/06; H02H 3/093; H02H 3/04; H02H 3/042; H02H 3/044; H02H 3/046; H02H 3/048; H02H 3/335; H02H 3/08; H02H 3/081; H02H 3/083; H02H 3/085; H02H 3/10; H02H 3/105; H02H 3/12; H02H 3/13; H02H 3/16; H02H 3/162; H02H 3/165; H02H 3/24; H02H 3/253; H02H 3/247; H01H 73/06; H01H 73/08; H01H 73/12; H01H 73/20; G01R 1/36; G01R 31/08; G01R 11/00; G01R 11/02; G01R 11/04; G01R 11/16; G01R 11/48; G01R 11/46; G01R 11/465; G01R 13/02; G01R 13/40; G01R 13/401; G01R 13/402; G01R 13/408; G05F 1/573; G05F 1/569; H03K 17/08
See application file for complete search history.

(56) References Cited

U.S. PATENT DOCUMENTS

| | | | | |
|---|---|---|---|---|
| 5,956,218 | A * | 9/1999 | Berthold | H02H 3/05 361/42 |
| 6,242,708 | B1 * | 6/2001 | Marchand | H01H 33/6661 218/153 |
| 7,945,876 | B2 * | 5/2011 | Rautio | G06F 30/367 716/104 |
| 2003/0184931 | A1 * | 10/2003 | Morris | H02H 11/005 361/42 |
| 2014/0226243 | A1 * | 8/2014 | Williams | H02H 1/06 361/86 |
| 2014/0265900 | A1 * | 9/2014 | Sadwick | H05B 45/00 315/200 R |
| 2016/0133410 | A1 * | 5/2016 | Bock | H01H 47/325 361/160 |
| 2016/0141121 | A1 * | 5/2016 | Martin | H01H 9/20 200/43.19 |
| 2016/0329696 | A1 * | 11/2016 | Franke | H01H 71/125 |
| 2016/0365214 | A1 * | 12/2016 | Franke | H01H 71/7409 |
| 2017/0189640 | A1 * | 7/2017 | Sadwick | H05B 47/155 |
| 2017/0346272 | A1 * | 11/2017 | Meyer | H02H 3/16 |
| 2019/0067929 | A1 * | 2/2019 | Kopaczewski | G01R 31/3275 |
| 2020/0013574 | A1 * | 1/2020 | Krauss | H01H 71/10 |
| 2020/0021099 | A1 * | 1/2020 | Borgwardt | H02H 3/08 |
| 2020/0083697 | A1 * | 3/2020 | Fischer | H02H 3/165 |

* cited by examiner

ELECTRONIC TRIP UNIT FOR A LOW-VOLTAGE CIRCUIT BREAKER INCLUDING A RECEPTACLE FOR A MODULE, AND A MODULE FOR CONNECTION TO THE ELECTRONIC TRIP UNIT

PRIORITY STATEMENT

The present application hereby claims priority under 35 U.S.C. § 119 to German patent application number DE 102017211552.1 filed Jul. 6, 2017, the entire contents of which are hereby incorporated herein by reference.

FIELD

At least one embodiment of the invention generally relates to an electronic trip unit for a low-voltage circuit breaker for a three-phase AC circuit, and/or to a module for an electronic trip unit for a low-voltage circuit breaker.

BACKGROUND

Circuit breakers are protection devices which function in a similar manner to a fuse. Circuit breakers monitor the current flowing through them via a conductor and interrupt the electric current or energy flow to an energy sink or a load, this being called tripping, when protection parameters, such as current limit values or current/time period limit values, that is to say when a current value lasts for a certain time period, are exceeded. The set current limit values or current/time period limit values are corresponding reasons for tripping. Interruption is performed, for example, by mechanical switching contacts of the circuit breaker which are opened.

Particularly for low-voltage electrical circuits or supply systems, there are various types of circuit breakers, depending on the level of the provided electric current in the electrical circuit.

Within the meaning of the application, circuit breaker refers to, in particular, switches as are used in low-voltage installations for currents of from 63 to 6300 amperes. Molded case circuit breakers are especially used for currents of from 63 to 1600 amperes, in particular of from 125 to 630 or 1200 amperes. Air circuit breakers are used, in particular, for currents of from 630 to 6300 amperes, especially of from 1200 to 6300 amperes.

Air circuit breakers are termed ACB for short, and molded case circuit breakers are termed MCCB for short.

Low voltage refers to, in particular, voltages of up to 1000 volts AC or 1500 volts DC. Low voltage especially means, in particular, voltages which are greater than extra-low voltage, with values of 25 volts or 50 volts AC and also 60 volts or 120 volts DC.

Within the meaning of the application, circuit breaker refers to circuit breakers with an electronic trip unit, ETU for short.

The electronic trip unit is the control unit of the circuit breaker. It is controlled, for example via a microprocessor. Ascertained or measured current values of the electrical circuit are supplied to the electronic trip unit. The current values are compared with the set protection parameters or response values, current limit value—level of the current, current/time limit value—high current lasts for a specific period of time, and a tripping signal is output in the event of the protection parameters or response values being exceeded, for the purpose of interrupting the electrical circuit. In contrast to a fuse, these protection parameters or response values can be adjusted in the case of a circuit breaker, for example via the electronic trip unit. The electronic trip unit is usually mounted over the front of the circuit breaker in an accessible manner. The protection parameters can be adjusted or parameterized by this.

To this end, the electronic trip unit has various functions, such as short-circuit protection, overcurrent protection, interruption with a short time delay (in the event of high currents), interruption with a long time delay (in the case of medium currents), residual current protection, protection against ground faults etc.

Functions which can be upgraded or functions or options which are to be enabled are often required for electronic trip units. In this case, the enabling operation can be performed in various ways.

However, in protection devices, such as circuit breakers, it is sometimes necessary for the existing options to be identifiable at any time, that is to say in the switched-off state too.

SUMMARY

Methods for enabling by way of software-based enable codes are often used. The enabling operation is indicated via a display. The inventors have recognized, however, that these have the disadvantage that they are not visible when the circuit breaker is switched off or tripped.

At least one embodiment of the present invention is directed to improving a circuit breaker or an electronic trip unit for a circuit breaker to improve the display and enabling of functions, wherein, as far as possible, the external appearance of the circuit breaker or of the electronic trip unit should remain unchanged and the enabled function should also be visible when the circuit breaker is deenergized.

At least one embodiment of the present invention is directed to a circuit breaker and/or to a module.

At least one embodiment of the invention provides an electronic trip unit for a low-voltage circuit breaker for an electrical three-phase AC circuit, comprising:

a housing including a front face, a rear face, a left-hand face, a right-hand face, a top face and bottom face;

a controller, configured to compare supplied current measurement values of the three-phase AC circuit with at least one of current limit values, current period limit values and time period limit values and output a tripping signal, for interrupting the three-phase AC circuit, upon the at least one of current limit values, current period limit values and time period limit values being exceeded; and a receptacle for a module, configured in such to provide a force-fitting connection between the electronic trip unit, wherein the module is receivable by the left-hand face, the right-hand face, the top face or the bottom side face of the housing;

wherein the front face of the housing includes a viewing window, such that at least a portion of the module, upon the module being received by the housing, is visible, and wherein at least one function of the electronic trip unit is activated upon the module being received.

At least one embodiment of the invention is further directed to a corresponding module for an electronic trip unit for a low-voltage circuit breaker.

BRIEF DESCRIPTION OF THE DRAWINGS

The described properties, features and advantages of embodiments of the invention and the way in which these are achieved will become clearer and more distinctly understood in connection with the following description of the example embodiments which will be explained in more detail in connection with the drawings.

In the drawings.

DETAILED DESCRIPTION OF THE EXAMPLE EMBODIMENTS

Figure 1:
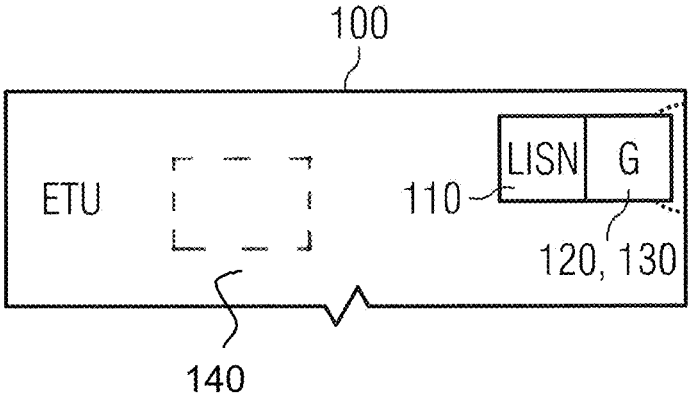
FIG. 1 shows a first schematic illustration of the front face for the purpose of explaining an embodiment of the invention.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

At least one embodiment of the invention provides an electronic trip unit for a low-voltage circuit breaker for an electrical three-phase AC circuit:

comprising a housing with a front face, rear face, left-hand, right-hand, top and bottom side face, comprising a controller which is configured in such a way that supplied current measurement values of the three-phase AC circuit are compared with current or/and current/time period limit values and a tripping signal for interrupting the three-phase AC circuit is output in the event of the limit values being exceeded, the electronic trip unit has a receptacle for a module, which receptacle is configured in such a way that:

a force-fitting connection is provided between the electronic trip unit and the module, the module is received by the left-hand, right-hand, top or bottom side face, that is to say the front face remains untouched, the front face has a viewing window, in such a way that at least a portion of a received module is visible, that is to say a portion of the received module is always visible, in particular the entire module does not have to be visible; a section of the module is sufficient, that at least one function of the electronic trip unit is activated when the module is received.

At least one embodiment of the invention has the advantage that:

the front face is substantially unchanged both without and with the module, a received/inserted module is visible through the viewing window on the front face even in the deenergized state of the circuit breaker/the electronic trip unit, that is to say it is possible to identify whether a function/option has been activated in the deenergized state too, by labeling the module or/and the front face, for example using alphanumeric symbols, information is provided about the enabled function when the module is received/inserted. When the module is not received, there is no labeling, that is to say a function/option has not been activated.

Advantageous refinements of embodiments of the invention are specified in the claims.

In an advantageous refinement of at least one embodiment of the invention, the receptacle is identified by a portion or an opening of the left-hand, right-hand, top or bottom side face.

This has the particular advantage that a module can be inserted through a lateral opening of the electronic trip unit.

In an advantageous refinement of at least one embodiment of the invention, the front face completely protects the module against access. The viewing window comprises a transparent material, for example a transparent plastic.

This has the particular advantage that complete front-side mechanical shielding of the module is provided and, in addition, the visual appearance is fundamentally unchanged.

In an advantageous refinement of at least one embodiment of the invention, the module is locked and can be received or removed only in the zero-voltage state.

This has the particular advantage that the module can be exchanged only in the zero-voltage state and therefore increased operational reliability is provided.

In an advantageous refinement of at least one embodiment of the invention, the viewing window has a round or quadrangular, in particular rectangular or square, shape.

This has the particular advantage that an attractive design is provided.

In an advantageous refinement of at least one embodiment of the invention, a contact switch is provided, which is closed when the module is received, so that a function of the electronic trip unit is activated.

This has the particular advantage that a particularly simple way of enabling functions is provided.

In an advantageous refinement of at least one embodiment of the invention, there is an electrical connection between the electronic trip unit and the module.

This has the particular advantage that a further simple way of activating functions via an electrical interface is provided.

In an advantageous refinement of at least one embodiment of the invention, the electrical connection has at least two contacts.

This has the particular advantage that a particularly simple way of activating functions via an electrical interface is provided.

In an advantageous refinement of at least one embodiment of the invention, a function of the electronic trip unit is activated by a module in the event of a short circuit between two contacts.

This has the particular advantage that a particularly simple way of activating functions via an electrical interface takes place.

In an advantageous refinement of at least one embodiment of the invention, the at least two contacts, in particular 3, 4, 5, 6, 7, 8 or 9 contacts, form a serial or parallel interface via which data can be ascertained from a module.

This has the particular advantage that a more complex way of activating functions is possible, in particular that functions cannot be activated without further knowledge.

In an advantageous refinement of at least one embodiment of the invention, an encoded communication with a module can be transmitted via the interface.

This has the particular advantage that protection against unauthorized enabling of functions is provided.

In an advantageous refinement of at least one embodiment of the invention, a board which is at least partially visible through the viewing window is provided within the housing at least partially parallel to the front face.

This has the particular advantage that, when the module is not received, a unit-internal termination which blocks a view into the interior of the unit is provided. Furthermore, it is possible to easily identify whether a module is inserted. This can be done, for example, by a module being a different color to the board or by labeling, for example by way of alphanumeric symbols or signs, on the module or/and the plate if the module and plate are of the same color or similar colors; it is possible to identify that a module is not received/is received.

In an advantageous refinement of at least one embodiment of the invention, the board is a printed circuit board.

This has the particular advantage that both a unit-internal termination and also a support for components of the electronic trip unit are provided, so that a separate board is saved.

In an advantageous refinement of at least one embodiment of the invention, the rear side of the front face or/and the board has/have a plug-in connector for receiving the module.

This has the particular advantage that a simple way of fastening the module, in particular also of electrically connecting the module, is provided.

At least one embodiment of the invention is further directed to a corresponding module for an electronic trip unit for a low-voltage circuit breaker.

All refinements, including all embodiments, and also referring back only to individual features or combinations of features of the embodiments and/or claims, improve a circuit breaker.

FIG. 1 shows a schematic illustration of a front face of an electronic trip unit ETU, having the front face 100. Internal to the ETU is a controller 140. Labels 110, for example by way of symbols or/and in alphanumeric form, in the example the letters "LISN", relating to permanently installed or permanently enabled functions of the electronic trip unit ETU are provided on the front face 100. In the example according to FIG. 1, a module 120 is received by the electronic trip unit ETU. The module has a label, for example again by way of symbols or/and in alphanumeric form, in the example the letter "G", relating to functions of the electronic trip unit ETU which are enabled by the module.

At least part of the module 120 is visible through a viewing window 130. In particular the labelled part of the module 120.

In this case, the viewing window 130 can be an opening in the front face 100, for example a round or quadrangular opening, for example in rectangular or square form, as shown in FIG. 1. However, the opening/the viewing window can also comprise a transparent material, such as a transparent plastic, so that the front face is closed.

Figure 2:
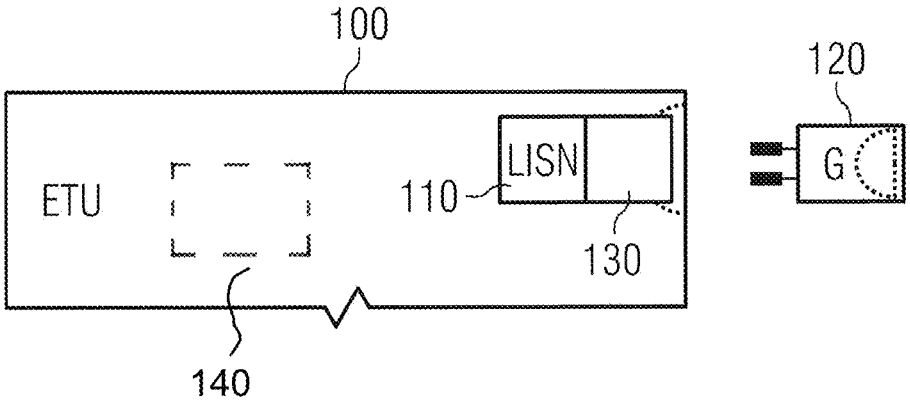
FIG. 2 shows a second schematic illustration of the front face for the purpose of explaining an embodiment of the invention.

FIG. 2 shows an illustration according to FIG. 1, with the difference that the module 120 is not received/is not inserted in the electronic trip unit ETU. Again, controller 140 is illustrated internal to the ETU.

Here, the viewing window 130 shows a free insertion space, in particular there is no labelling in the viewing window, so that it is possible to identify that no further functions are enabled.

Figure 3:
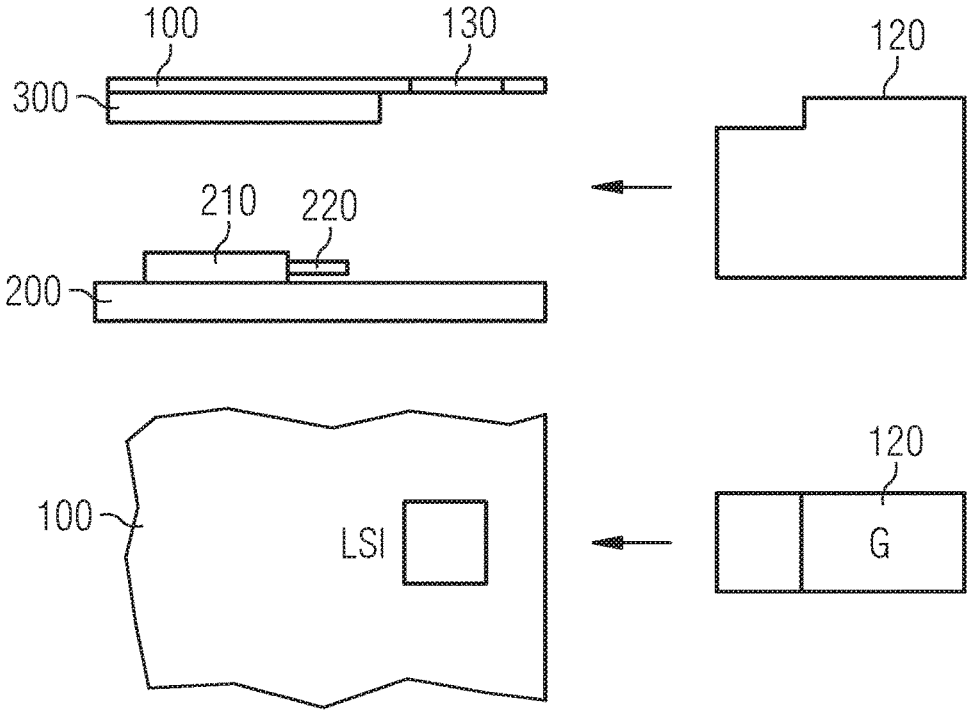
FIG. 3 shows a first illustration from above for the purpose of explaining an embodiment of the invention.

FIG. 3 shows a schematic illustration according to FIG. 2 from above, that is to say without the module 120 received. A plate 200, which can be configured as a printed circuit board, is situated parallel to the front face 100 containing the viewing window 130. A printed circuit board usually has electrical conductor tracks and components, such as resistors, capacitors, coils, diodes, transistors or/and electrical circuits etc. In particular, no components are arranged in the region of the viewing window.

The board or printed circuit board can have an element 210. In one variant, the element 210 can be a contact switch. In this case, the element 210 has an element part 220, wherein the element part 220 is a switching lever of the contact switch.

In another variant, the element 210 can be a plug-in connector, wherein the element parts are contacts, for example pins, of the plug-in connector.

In this case, the module 120 has corresponding mating contacts, not illustrated.

The front face 100 can further have a parallel housing part 300 which is connected at least to a rear-side partial area of the front face 100, the housing part serving, for example, to reinforce the front face 100 or/and as a stop for the module 120.

Figure 4:
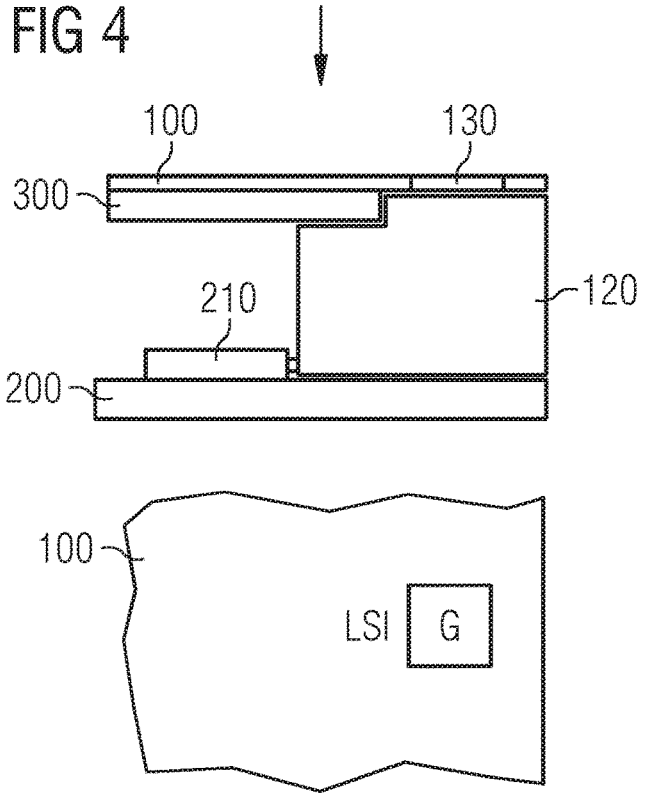
FIG. 4 shows a second illustration from above for the purpose of explaining an embodiment of the invention.

FIG. 4 shows an illustration according to FIG. 3, with the difference that the module 120 has been received by the electronic trip unit ETU, analogously to FIG. 1.

If the element 210 is designed as a contact switch with a switching lever, the switching lever is operated, for example inserted or pushed into the housing of the contact switch, by the module 120, in particular by the housing of the module 120, as a result of which a function of the electronic trip unit is activated. Various functions can be activated by a plurality of parallel contact switches. In this case, the module contains openings for the switching levers which are not to be operated.

If the element 210 is a plug-in connector with contacts, the module 120 then has corresponding mating contacts, not illustrated; that is to say, the module 120 receives, for example, the contacts. This can also be realized the other way around.

Owing to short-circuiting linking operations in the module, at least one electronic component, such as a resistor, capacitor, inductor coil and/or integrated electrical circuit, such as a memory module, shift register or/and microprocessor in particular, corresponding activation or enabling of a function can be performed, for example, by checking the type, the physical value of the component, or the like. More complex, protocol-like checks, for example in encoded form, could also be performed. To this end, the plug-in connector can have a plurality of contacts, in particular 3, 4, 5, 6, 7, 8 or 9 contacts, which, for example, form a serial or parallel interface in order to ascertain data from the module. Depending on the function to be activated, different data is stored or components/short-circuiting links are integrated in the module.

Owing to the plug-in connector, a force-fitting connection or/and electrical connection can be realized.

As an alternative or in addition, the module 120 can have a stepped portion which forms an interlocking or/and force-fitting connection with the housing part 300.

An embodiment of the invention will be described once again, in other words, in the text which follows.

A solution according to an embodiment of the invention allows simple upgrading of an electronic trip unit. The electronic trip unit is provided with a receptacle, for example an insertion space in which the functions or options can be activated, that is to say enabled, via an electrical interface (simple contact or bus system, such as SPI/I2C).

The simplest embodiment here is a contact which is short-circuited by the insert module.

If more stringent requirements are made in respect of activation or enabling, the interface can be designed as a serial bus. By way of example, the module to be inserted contains a memory module. In the case of even more stringent requirements, a memory with a cryptographic function.

Both the corresponding hardware interface and also methods for identifying the module are implemented in the electronic trip unit.

Furthermore, the electronic trip unit optionally has the capability to prevent the activation of impermissible functions (technically not possible, option not purchased) by way of a functionality (possibly stored in encoded form). Therefore, a second way of activating functions is required. Incompatibilities can be ascertained and indicated.

The front face is designed such that a transparent window is located in the position of the receptacle for the modules. Therefore, it is possible to identify at any time whether a module, that is to say an additional option, is activated and which one. By suitable labelling of the front sheet, the layout can be designed such that an attractive overall impression is provided both when the module is not inserted (background color behind the window is the same as the foreground color) and also when the module is inserted (labelling/lettering in one line).

In this case, the module is received/supplied or installed explicitly through one of the side faces of the electronic trip unit.

Any requirements in respect of exchangeability (during operation or when the device is deactivated) can be realized given corresponding configuration of the housing.

A solution according to an embodiment of the invention provides a simple solution to enabling options in the device while at the same time displaying the existing options in all operating cases.

In comparison to a solution in which the module is mounted on the front panel, the advantage in this case is that no blank modules, which are necessary if there is no module, are required. Therefore, a considerable amount of expenditure is saved.

Although the invention has been more specifically illustrated and described in detail by way of the example embodiment, the invention is nevertheless not restricted by the examples disclosed and other variations can be derived therefrom by the person skilled in the art, without departing from the scope of protection of the invention.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electronic trip unit for a low-voltage circuit breaker for an electrical three-phase AC circuit, comprising:

a housing including a front face, a rear face, a left-hand face, a right-hand face, a top face and bottom face;

a controller, configured to compare supplied current measurement values of the electrical three-phase AC circuit with at least one of current limit values, current period limit values and time period limit values, and output a tripping signal, for interrupting the electrical three-phase AC circuit, upon the at least one of the current limit values, the current period limit values and the time period limit values being exceeded; and a receptacle for a module, configured to provide a force-fitting connection between the module and the electronic trip unit, wherein the module is receivable by the left-hand face, the right-hand face, the top face or the bottom face of the housing;

wherein the front face of the housing includes a viewing window, at least a portion of the module, upon the module being received by the housing, being visible, wherein at least one function of the electronic trip unit is activated upon the module being received, and wherein the module is locked and is receivable or removable only in a zero-voltage state.

2. The electronic trip unit of claim 1, wherein the module is receivable by a portion or an opening of the left-hand face, right-hand face, top face or bottom side face of the housing.

3. The electronic trip unit of claim 1, wherein the front face of the housing is configured to completely protect the module against access, upon receipt, and wherein the viewing window includes a transparent material.

4. The electronic trip unit of claim 1, wherein the viewing window includes a round or quadrangular shape.

5. The electronic trip unit of claim 1, wherein a contact switch is provided, the contact switch being configured to be closed upon the module being received, such that a function of the electronic trip unit is activated.

6. The electronic trip unit of claim 1, wherein an electrical connection is present between the electronic trip unit and the module.

7. The electronic trip unit of claim 6, wherein the electrical connection includes at least two contacts.

8. The electronic trip unit of claim 7, wherein a function of the electronic trip unit is activatable by the module upon a short circuit occurring between the at least two contacts.

9. The electronic trip unit of claim 7, wherein the at least two contacts form a serial or parallel interface via which data is ascertainable from the module.

10. The electronic trip unit of claim 9, wherein an encoded communication, including a module, are transmittable via an interface.

11. The electronic trip unit of claim 1, further comprising:

a board, at least partially visible through the viewing window, provided within the housing, at least partially parallel to the front face of the housing.

12. The electronic trip unit of claim 11, wherein the board is a printed circuit board.

13. The electronic trip unit of claim 12, wherein a rear side of at least one of the front face of the housing and the board includes a plug-in connector for receiving the module.

14. A module for the electronic trip unit of claim 1, comprising:

at least two electrical contacts; and a short-circuiting link to connect the at least two electrical contacts; and an electronic component to connect the at least two electrical contacts.

15. The electronic trip unit of claim 2, wherein the front face of the housing is configured to completely protect the module, upon receipt, against access and wherein the viewing window includes a transparent material.

16. The electronic trip unit of claim 4, wherein the viewing window includes a rectangular or square shape.

17. The electronic trip unit of claim 2, wherein a contact switch is provided, the contact switch being configured to be closed upon the module being received, such that a function of the electronic trip unit is activated.

18. The module of claim 14, wherein the electronic component is at least one of a resistor, a capacitor, an inductor coil, and at least one integrated electrical circuit.

19. The module of claim 18, wherein the at least one integrated electrical circuit is at least one of a memory module, a shift register, and a microprocessor.

* * * * *